United States Patent [19]

Wells

[11] 4,216,534

[45] Aug. 5, 1980

[54] DECOYING ACOUSTIC HOMING TORPEDOES

[75] Inventor: William E. Wells, Panama City, Fla.

[73] Assignee: The United States of America as represented by the Secretary of the Navy, Washington, D.C.

[21] Appl. No.: 39,413

[22] Filed: Jun. 28, 1960

[51] Int. Cl.[2] ..... H04K 3/00

[52] U.S. Cl. ..... 367/1; 367/106; 367/137

[58] Field of Search ..... 340/2, 5, 3, 384, 5 D; 35/10.4, 25; 343/18; 116/27, 26; 114/235, 235.2, 21; 325/102, 111, 116, 132; 244/14.1; 367/1, 137, 138

[56] References Cited

U.S. PATENT DOCUMENTS 3,209,314 9/1965 Myers et al. ..... 367/1

*Primary Examiner*—Richard A. Farley

*Attorney, Agent, or Firm*—Louis A. Miller; Rolla N. Carter

EXEMPLARY CLAIM

1. Apparatus for protecting a pelagic vessel from attack by acoustic homing torpedoes comprising a vehicle to be towed submerged a substantial distance behind said vessel, an electroacoustic transducer mounted in said vehicle and having a forwardly directed directivity pattern, a source of constant amplitude oscillating electrical wave energy, means for modulating the oscillating frequency of said wave energy cyclically over a range inclusive of the operating frequencies of such torpedoes and at a linear rate slow enough to satisfy the energy requirement in the band pass of passive torpedo circuits and fast enough to satisfy the rise time of active torpedo discriminator circuits, and means for energizing said transducer with the modulated wave energy from said source.

2 Claims, 5 Drawing Figures

DECOYING ACOUSTIC HOMING TORPEDOES

The invention described herein may be manufactured and used by or for the Government of the United States of America for governmental purposes without the payment of any royalties thereon or therefor.

The present invention relates to the protection of ships from torpedoes and more particularly to an underwater acoustic decoy having the capability of attracting both passive and active acoustic homing torpedoes.

An object of the invention is to provide a method and apparatus for decoying acoustic homing torpedoes.

Another object of the invention is to provide a decoy for a doppler gated active acoustic homing torpedo.

The threat presented by acoustic homing torpedoes has been difficult to counter effectively. Known passive acoustic homing torpedoes have been successfully decoyed by utilizing mechanical noisemakers, but noisemakers possess the disadvantage that their major output is in the frequency range (about 14 KC) of present day sonar, thereby effectively preventing sonar tracking while the decoy is operating and attempts at sharing time between the decoy and sonar are in derogation of the effectiveness of both. A typical active type homing torpedo requires a signal corresponding to an echo of a certain minimum duration and a given frequency band; and in more sophisticated form, referred to as doopler gated, a minimum target doppler is required to satisfy the homing instincts of the torpedo. In other words, a doppler gated homing torpedo will not home on a target which appears to be stationary or moving at a speed less than that required to provide the selected minimum target doppler, thereby defeating a hovering type launched decoy of the transponder type.

In accordance with the present invention, both active and passive acoustic homing torpedoes are decoyed by energizing an underwater transducer with a constant amplitude frequency modulated continuous wave oscillation which is swept through a frequency range wide enough to include the operating frequencies of both passive and active torpedoes and at a sweep rate such that energy is present in the response curve for a time interval sufficient to initiate a steering trip, i.e., long enough to satisfy the response time of the torpedo's steering circuit. Also, as the decoy signal sweeps through the bandwidth of a passive torpedo's receiver, usually tuned at 24½KC and 5KC wide, it simulates noise signals to provide the torpedo with homing information. Thus, if the sweep frequency is 8 cycles per second, 8 signals a second are recognized by the passive torpedo. The pass band of the receiver in an active torpedo is normally about 5KC wide so that for the frequency sweep contemplated below a sweep frequency of the order of 8 cycles per second allows the center frequency component to remain within this bandwidth for the response time of the steering circuit. e.g., 3 milliseconds. As the transmitted frequency modulated sound approaches the resonant frequency of the active torpedo's circuit, it follows the skirts of the response curve of the torpedo's tuned circuit to satisfy the torpedo with the fast rise time in signal amplitude required for a simulated echo.

Active homing acoustic torpedoes can be designed, and usually are, to discriminate against a steady state type of signal and thereby ignore any such signal when used as a decoy. Such a discriminator produces an output only when the steady signal is first turned on, or is turned off. Therefore, a successful decoy must provide a signal which is turned on and off such as the normal torpedo ping, or which simulates a rapid rise of input signal. Active torpedoes are designed to operate at a specific frequency (unknown to the decoy designer) and to accept signals only within a narrow band about this frequency. The FM decoy of the invention sweeps through the broad band of frequencies within which the torpedo must operate to be effective. As the signal sweeps through the narrow pass band of the torpedo, the input to the discriminator rises rapidly (much the same as a ping echo at the torpedo operating frequency) and is passed to provide steering information.

Passive torpedoes homing on a band of radio frequency noise of a ship utilize steady state signals for steering and do not incorporate discriminators as do active torpedoes. Passive torpedoes steer toward the signal source by phase comparison and require only sufficient signal to provide this phase relationship. The FM decoy signal would pass through the torpedo's pass band approximately 8 times per second (sweep rate 8CPS) providing ample steering information.

In order to relate the above general description of the invention and its functioning to a specific embodiment of the invention to be described in detail below, it is assumed, consistent with present day practice, that active homing torpedoes to be decoyed operate on a bandwidth of 5KC in the frequency range between 20KC and 80KC and require an "echo type" signal, i.e., one rapidly increasing in amplitude and of a duration of at least 3 milliseconds to satisfy its minimum dwell time, it being immaterial (see below) whether or not it is doppler gated. It is also assumed that the passive homing torpedoes to be decoyed operate on a bandwidth of 5KC about a center frequency of the order of 25KC and require only sufficient signal to make a phase comparison. Torpedoes having the above assumed characteristics will home on a decoy designed in accordance with the invention to have a frequency sweep of 60KC, say from 20KC to 80KC, or vice versa, a sweep frequency of 8 cycles per second and an output of constant amplitude in excess of the amplitude of the echo return to an active torpedo and also the amplitude of the ship's noise within the response band of the passive torpedo. A sweep rate of 8 cycles per second over a sweep range of 60KC, assuming a linear function sweep (sawtooth), means that each center frequency within the sweep range will be present in the corresponding 5KC bandwidth (at the 3 db down points) for approximately 10 milliseconds thereby satisfying a typical echo energy requirement of an active torpedo of 3 or more milliseconds minimum dwell time and is well under the maximum permissible dwell time generally imposed by the recycling rate of the torpedo, usually about 1 second. Since the decoy signal satisfies the receiving circuit of the active torpedo, it is obvious that whether or not the torpedo is doppler gated is immaterial and thus the decoying signals offers a false doppler even though the decoy is stationary. This sweep frequency of 8 cycles per second will provide the passive torpedo with a noise signal 8 times each second which has been found to provide ample steering information.

The invention will best be understood by referring to the accompanying drawing in which.

Figure 1:
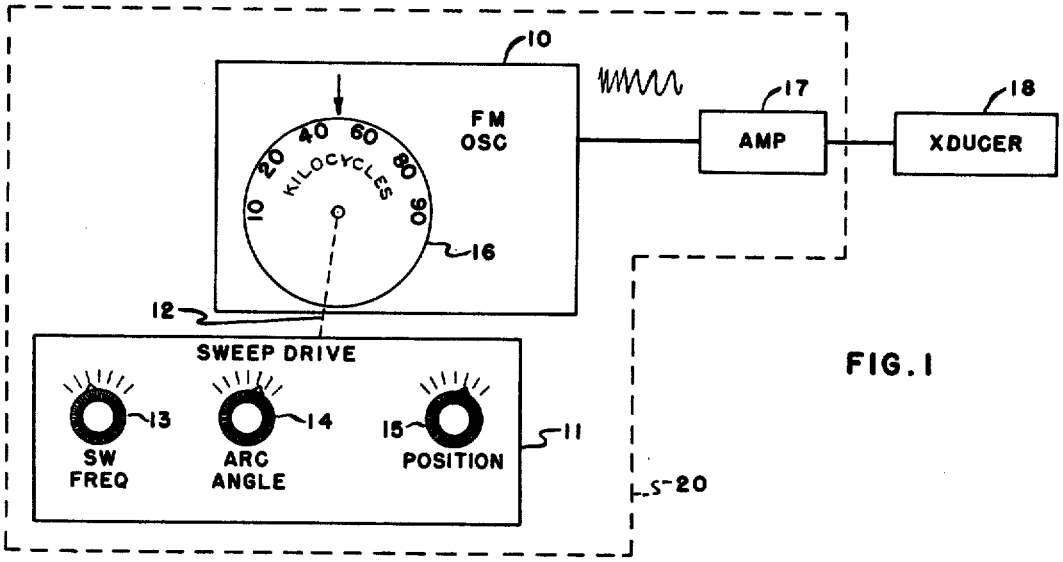
FIG. 1 is a block diagram of an apparatus for practicing the invention.
Figure 4:
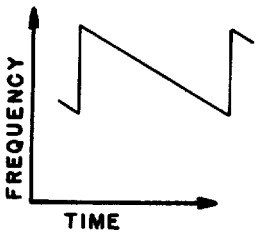
FIG. 4 is a fragmentary-time graph of a sawtooth signal which may be employed.
Figure 5:
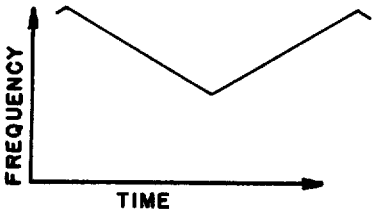
FIG. 5 is a frequency-time graph of the signal transmitted by the apparatus shown in FIG. 1.

As shown in FIG. 1 of the drawing, a suitable source of frequency modulated oscillation 10 which may be of the sawtooth generator type producing a signal as shown in FIG. 4 but here shown as comprising a conventional oscillator with a mechanical sweep drive 11 to provide an output frequency varying with time as shown in FIG. 5 thus forming the frequency modulated signal desired. The oscillator 10 is mechanically driven through a shaft 12 by the sweep drive 11 at a sweep frequency determined by the adjustment of a sweep frequency knob 13 and through an angle selected by am adjustable knob 14 which angle is selected to cover the desired frequency range by a position knob 15. A calibrated dial 16 carried by the oscillator 10 is secured to the shaft 12 to provide a visual indication of the sweep of the frequency, and the center frequency about which the output frequency is varied. The output of the oscillator 10 is fed through an amplifier 17 to a suitable underwater transducer 18 which preferably has an omnidirectional directivity pattern when the decoy is employed as a launched decoy and when towed behind a vessel to be protected such directivity pattern is preferably 120° in horizontal angle and say 60° in vertical angle with its principal axis directed beneath the towing vessel.

Figure 2:
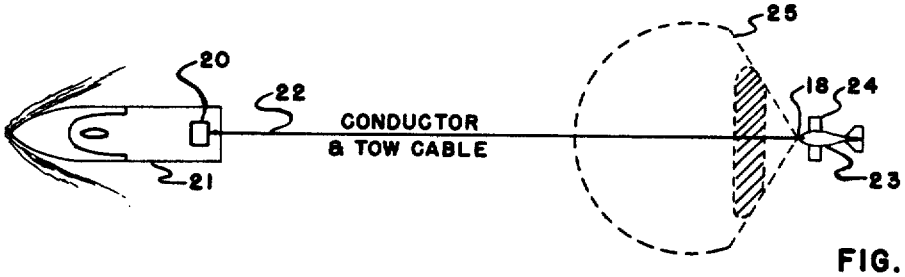
FIG. 2 shows the system of the invention arranged to protect a surface vessel.

One suitable decoy spread is shown in FIG. 2 wherein a shipboard unit 20 comprising the oscillator 10, the sweep drive 11 and the amplifier 17 of FIG. 1 is mounted on a vessel 21 which through a conductor and tow cable 22 powers and tows an underwater vehicle 23 provided with diving vanes 24 which in a known manner maintain the vehicle when under tow at a desired constant depth. The vehicle is preferably towed at a depth to carry the transducer below the draft of the towing vessel not only to place the transducer below the turbulence of the wake but also to prevent the transmitted sound from being baffled by the ship. The vehicle 23 is also stabilized against pitch, roll and yaw in a known manner not here pertinent. The transducer 18 mounted in the nose of the vehicle 23 thus has its directivity pattern 25 directed forwardly to surround the vessel 21 with its protective decoying influence. The length of the tow cable 22 is long enough, say 600 feet, to keep the towing ship out of range of the reattack trajectory of a decoyed torpedo. The conductor cable, which may be separate from the tow cable, includes a coaxial cable for carrying the frequency modulated energy to the transducer 18 and other lead wires for conveying power to the vehicle's stabilizing mechanism and for desired instumentation.

Figure 3:
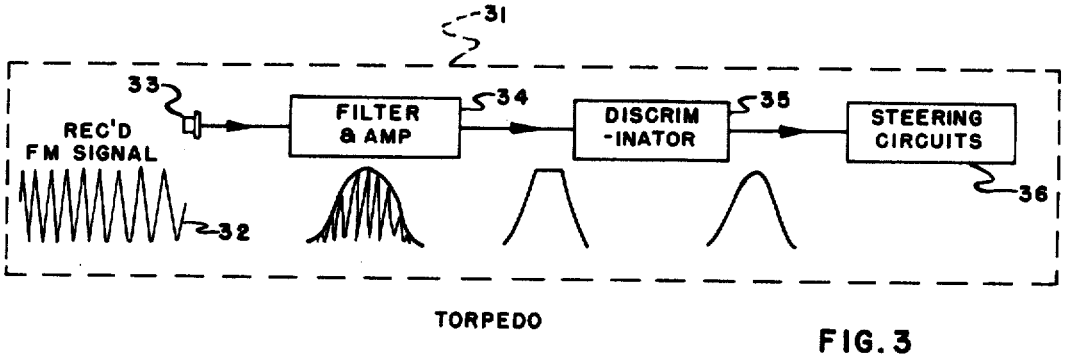
FIG. 3 illustrates a typical active torpedo receiving circuit to be decoyed.

As shown in FIG. 3, a representative active homing torpedo 31 upon receipt of a frequency modulated signal 32 emanated by the decoy transducer 18, processes the signal as follows: The acoustic pressure delivered by the decoy is translated to an electrical signal by the torpedo's transducer 33, fed through an amplifier and filter network 34 which for example may have a pass band of ±2.5KC of the torpedo's operating frequency forming a total energy bandwidth of 5KC. The energy processed by the filter network 34 is passed to a discriminator network 35 which prohibits the passage of steady state signals and allows only fast rise time signals to be processed. The received frequency modulated signal has a fast rise time and a reasonably long dwell time which meets the requirement for passage through the discriminator network 35. The discriminator network 35 in turn passes the decoy's energy on to steering circuits 36 which direct the torpedo toward the decoy. By way of example, a typical active acoustic homing torpedo has a muting time of approximately 34 milliseconds consisting of a ping time of 17 milliseconds and an interval immediately thereafter of 17 milliseconds for volume reverberation to die out and thereafter a listening period of about 1 second at the end of which the cycle is again initiated.

In the case of a passive acoustic homing torpedo which utilizes a phase comparison system to steer on radiated target noises, it is unlike the active torpedo described above since a typical passive homing torpedo will steer on any steady state signal at the torpedo's operating frequency, usually 24.5KC, as well as on noise signals of this frequency repeated at a subaudible rate such as produced by a ship underway. The FM satisfies the steady state (radiated target noise) signal giving required homing information to the passive acoustic torpedo. The sweep rate of the FM signal allows the decoy's energy to remain within the bandwidths of the torpedo's receiver for a sufficient length of time to simulate a steady state condition for its high frequency requirement. The phase comparison guidance system steers the torpedo onto the decoy.

An incidental but very real benefit afforded by the decoy system of the invention when operating as above described, is the confusion caused by the decoy signal in the mind of the commander of an attacking submarine. When it is remembered that a submarine commander quite frequently must compute the desired trajectory for an aimed torpedo utilizing course and speed of the target vessel, the best information concerning speed is obtained by counting through a suitable listening device the propeller beats of such vessel, from which information its speed is read off from previously prepared tables. In this connection the subaudible repetition rate, i.e., the sweep frequency, of the simulated noise signals transmitted by applicant's decoy closely simulates a vessel's propeller beat and hence the commander mistakingly aims his torpedo based upon inaccurate information as to the speed of the target vessel.

From the foregoing it will be evident to those skilled in the art that the present invention provides a decoy for presently known active and passive acoustic homing torpedoes and that even when stationary the decoy signal will satisfy the receiving circuit of an active torpedo which is doppler gated. The manner in which a decoyed torpedo is destroyed or otherwise defeated is a matter of choice and not here pertinent. While for the purpose of disclosing the invention a preferred embodiment thereof has been described in detail, it is to be understood that the invention is not limited thereto but is of the scope of the appended claims.

What is claimed is:

1. Apparatus for protecting a pelagic vessel from attack by acoustic homing torpedoes comprising a vehicle to be towed submerged a substantial distance behind said vessel, an electroacoustic transducer mounted in said vehicle and having a forwardly directed directivity pattern, a source of constant amplitude oscillating electrical wave energy, means for modulating the oscillating frequency of said wave energy cyclically over a range inclusive of the operating frequencies of such torpedoes and at a linear rate slow enough to satisfy the energy requirement in the band pass of passive torpedo circuits and fast enough to satisfy the rise time of active torpedo discriminator circuits, and means for energizing said transducer with the modulated wave energy from said source.

2. The method of decoying passive acoustic torpedoes which home on noise signals of a first frequency and a subaudible repetition rate such as produced by a ship underway and active acoustic torpedoes which home on signal echoes of a second frequency received from acoustic signal pulses transmitted from the torpedo which comprises continuously transmitting acoustic energy of substantially constant intensity from a location at substantial distance to the rear of said ship and characterized by a forwardly directed directivity pattern, and repeatedly sweeping the frequency of the transmitted acoustic energy over a range of frequencies including said first frequency and said second frequency at a subaudible repetition rate, the seep of the frequency and its repetition rate being chosen to satisfy the response time of a receiver having a selected pass band.

* * * * *